US007603976B2

(12) United States Patent
Abele

(10) Patent No.: US 7,603,976 B2
(45) Date of Patent: Oct. 20, 2009

(54) GAS EXCHANGE VALVE OF AN INTERNAL COMBUSTION ENGINE

(75) Inventor: Marcus Abele, Gerlingen (DE)

(73) Assignee: Mahle International GmbH, Stuttgart (DE)

( * ) Notice: Subject to any disclaimer, the term of this patent is extended or adjusted under 35 U.S.C. 154(b) by 490 days.

(21) Appl. No.: 11/444,880

(22) Filed: Jun. 1, 2006

(65) Prior Publication Data

US 2006/0278193 A1 Dec. 14, 2006

(30) Foreign Application Priority Data

Jun. 11, 2005 (DE) ..... 10 2005 027 130

(51) Int. Cl.
*F01L 3/20* (2006.01)

(52) U.S. Cl. ..... 123/188.3

(58) Field of Classification Search ..... 123/188.3, 123/188.2, 188.1, 188.9, 41.34, 90.23, 41.16, 123/41.41; 251/356, 367; 29/888.45, 888.451, 29/888.452, 888.453, 888.46

See application file for complete search history.

(56) References Cited

U.S. PATENT DOCUMENTS 2,371,548 A * 3/1945 Saffady ..... 123/41.16
2,471,937 A * 5/1949 Colwell ..... 29/888.451
4,187,807 A * 2/1980 Cemenska et al. ..... 123/41.34
6,354,258 B1 3/2002 Abele et al.
6,935,296 B2 8/2005 Abele et al.
7,240,895 B2 * 7/2007 Abele et al. ..... 251/356

FOREIGN PATENT DOCUMENTS

DE 198 04 053 A1 8/1999
DE 199 20 176 A1 11/2000
DE 102 57 505 B4 7/2003

* cited by examiner

*Primary Examiner*—Michael Cuff
*Assistant Examiner*—Ka Chun Leung
(74) *Attorney, Agent, or Firm*—Collard & Roe, P.C.

(57) ABSTRACT

With a gas exchange valve of an internal combustion engine having a hollow valve shaft (1) and valve disk (7), wherein the valve disk (7) has a valve tray (5) and a valve cone (6) connected to the outer edge thereof, whereby the valve cone (6) tapers with an increase in distance from the valve tray (5); the hollow valve shaft (1), passing completely through the space surrounded by the valve cone (6), is fixedly connected to the valve tray (5) at one end and at the other end is fixedly connected to the tapering end of the valve cone (6); the valve shaft (1) has parts telescoping into one another, namely a lower shaft part (3) facing the valve tray (5) and an upper shaft part (2) connected thereto, whereby the lower shaft part (3) engages in a form-fitting manner in the upper shaft part (2); and the upper shaft part (2) and the lower shaft part (3) are joined in a shaft connecting area (4), in particular by being welded together; coke deposits in the areas of the valve facing away from the combustion chamber, such deposits being promoted there due to interfering edges in the flow, are to be prevented.

3 Claims, 1 Drawing Sheet

GAS EXCHANGE VALVE OF AN INTERNAL COMBUSTION ENGINE

CROSS REFERENCE TO RELATED APPLICATIONS

Figure 1:
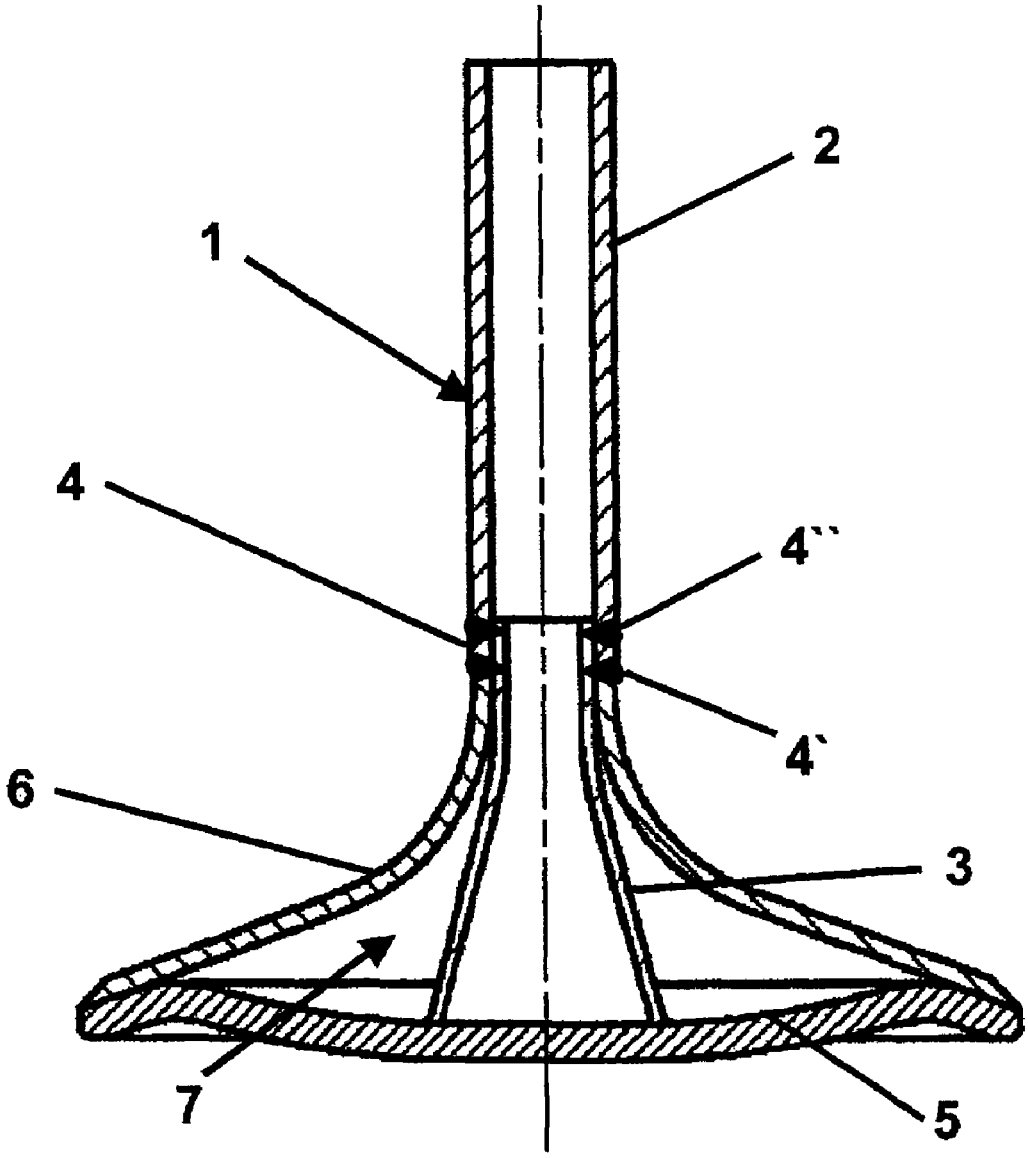

Applicant claims priority under 35 U.S.C. §119 of German Application No. DE 10 2005 027 130.8 filed Jun. 11, 2005.

The present invention relates to a gas exchange valve of an internal combustion engine according to the preamble of Patent claim 1.

STATE OF THE ART

Such a valve is known from German Patent DE 102 57 505 B4. With this valve, in the case of a relatively small valve shaft outside diameter, outside of the valve disk, the largest possible internal shaft cavity directly adjacent to the bottom of the valve disk is provided for filling with a shaker-suitable coolant, for example, that has a good thermal conductivity; this is accomplished through an increase in the diameter of the shaft within the valve disk. At the same time, an outer ring-shaped cavity should be present in the valve disk extending as far away axially as possible from the bottom of the valve disk and should have an insulating effect. To achieve the insulating effect, this cavity may be filled with air in the simplest manner or filled with a thermal insulation medium of any type. The special effect of such an inventive design is that through the optimum inside diameter of the valve shaft in the interior of the valve disk, heat can be withdrawn from the bottom of the valve disk in a highly effective manner, so that the coolant medium, which is in the form of a shaker in particular, ensures a good dissipation of heat within the shaft cavity in the opposite direction axially from the valve disk in the area of the valve shaft, where the valve shaft is guided inside the cylinder head and where the heat can flow into valve head.

With each valve, the valve cone is welded at its tapering end to the outside area of the shaft which engages in the valve cone. In the process here the weld forms a ring step on the outside circumference of the shaft, its radial inside edge being formed by the outside circumference of the shaft and its radial outside edge being formed by the outside circumference of the valve cone on the tapered end thereof. This ring step forms an unwanted flow disturbance edge for gas flowing around the valve in a gas exchange. This interfering edge promotes coking of cokeable ingredients within the gases flowing around it, resulting in coke deposits preferentially developing on the interfering edge. Such coke deposits are harmful.

PROBLEM

The present invention relates to the problem of preventing coke deposits on the peripheral areas of the equipment consisting of a valve shaft and valve cone situated outside of the valve tray.

SOLUTION

This problem is solved by an embodiment of a generic gas exchange valve according to the characterizing feature of Patent claim 1.

ADVANTAGES

The present invention is based on the general idea of providing the component composed of the valve cone and the valve shaft outside of the valve tray with an outside surface that is as smooth as possible on the whole, i.e., is free of steps in particular in order to prevent interfering flow edges that promote coke deposits in particular. The present invention places special emphasis on the connecting area between the valve shaft and the valve cone in the tapering valve cone area. This is advantageously achieved by the fact that the respective axial end areas of the valve cone and the upper shaft part abut directly against one another so they are flush with the outside, i.e., having the same outside diameter.

EMBODIMENTS OF THE PRESENT INVENTION

Advantageous embodiments of the present invention are the subject matter of the subclaims.

In one embodiment according to claim 2, the shaft connecting area, i.e., the area in which the top and bottom shaft parts are joined together on the one hand and the connecting area between the valve shaft and the valve cone on the other hand are designed to be intermeshing. Such a design may consist, for example, of providing a common weld through the butt gap between the valve cone and the upper part of the shaft which is directly adjacent.

Alternatively, according to claim 3, it may be expedient to provide an additional axially separate exclusive connecting area between the top and bottom shaft parts in addition to the joint connecting area.

EXEMPLARY EMBODIMENT

The present invention is explained in greater detail below on the basis of an advantageous exemplary embodiment.

The only FIGURE:

FIG. 1 shows a longitudinal section through a gas exchange valve.

A valve shaft 1 in an inventive gas exchange valve is made up of two parts, namely an upper shaft part 2 and a lower shaft part 3, which are telescoped together and are joined in a joining area 4, preferably by welding. In the telescoping connection, the lower shaft part 3 engages in the upper shaft part 2. Valves having such a design are also known as lightweight valves.

The connecting area 4 is made up of two axially separate special joining areas, namely a first special joining area 4' and a second special joining area 4".

In the first special joining area 4', the upper shaft 2 is welded to the valve cone 6 sealed by a valve tray 5 as components abutting against one another axially so they are flush on the outside, whereby the weld thereby produced at the same time includes the bottom shaft part 3 in this joint.

In a second special connecting area 41" which is included in the exemplary embodiment and is at a distance axially in the direction of the free shaft end as well as from the first special connecting area 4', only the upper and lower shaft parts 2, 3 are welded together, namely in such a way that a ring-shaped weld is situated axially completely in the area in which upper and lower shaft parts 2, 3 overlap.

In the first special connecting area 4', the outer areas of the valve cone 6 opening here on the one hand and the lower shaft part 3 on the other hand each have the same outside diameter, resulting in a smooth peripheral connecting area along which the gas flow can slide without any interfering edges.

The valve of the exemplary embodiment is primarily an intake valve of an internal combustion engine, and an exhaust valve may also be designed accordingly. The valve disk 7 of such a valve is composed here of a number of individual parts each welded together, namely a hollow valve cone 6, the valve tray 5 and the bottom shaft part 3. The hollow spaces on the one hand exists between the lower shaft part 3 and the valve cone 6 in the form of an annular space and within the lower shaft part 3 in the form of a hollow cone whose widened area is adjacent to the valve tray 5.

Due to the flush transition from the upper shaft 2 to the adjacent outside circumference of the valve cone 6 according to the present invention, the flow properties are definitely improved especially in an intake valve of an internal combustion engine but also in an exhaust valve, thereby preventing coke wall deposits in this area.

Due to a double connection, preferably a butt weld in the shaft area between the valve cone 6 and the upper shaft part 2 and on the other hand between the upper shaft part 2 and the lower shaft part 3, an especially high stability of the gas exchange valve in an internal combustion engine is achieved.

The invention claimed is:

1. A gas exchange valve of an internal combustion engine having a hollow valve shaft (1) and valve disk (7), wherein the valve disk (7) consists of a valve tray (5) and a valve cone (6) which is connected to the outer edge thereof, whereby the valve cone (6) tapers with an increase in distance from the valve tray (5);

the hollow valve shaft (1), passing completely through the space surrounded by the valve cone (6), is fixedly connected to the valve tray (5) at one end and at the other end is fixedly connected to the tapering end of the valve cone (6), the valve shaft (1) consists of parts telescoping into one another, namely a lower shaft part (3) facing the valve tray (5) and an upper shaft part (2) connected thereto, whereby the lower shaft part (3) engages in a form-fitting manner in the upper shaft part (2), and the upper shaft part (2) and the lower shaft part (3) are joined in a shaft connecting area (4), in particular by being welded together, wherein the upper shaft part (2) develops into the adjacent outside circumference of the valve cone in a flush manner on its outside circumference, so the upper shaft part (2) and the area of the valve cone (6) directly adjacent thereto have the same outside diameter, the shaft connecting area and the connecting area between the valve shaft (1) and the valve cone (6) are designed as intermeshing connecting areas (4').

2. A gas exchange valve of an internal combustion engine having a hollow valve shaft (1) and valve disk (7), wherein the valve disk (7) consists of a valve tray (5) and a valve cone (6) which is connected to the outer edge thereof, whereby the valve cone (6) tapers with an increase in distance from the valve tray (5), the hollow valve shaft (1), passing completely through the space surrounded by the valve cone (6), is fixedly connected to the valve tray (5) at one end and at the other end is fixedly connected to the tapering end of the valve cone (6), the valve shaft (1) consists of parts telescoping into one another, namely a lower shaft part (3) facing the valve tray (5) and an upper shaft part (2) connected thereto, whereby the lower shaft part (3) engages in a form-fitting manner in the upper shaft part (2), and the upper shaft part (2) and the lower shaft part (3) are joined in a shaft connecting area (4), in particular by being welded together, wherein the upper shaft part (2) develops into the adjacent outside circumference of the valve cone in a flush manner on its outside circumference, so the upper shaft part (2) and the area of the valve cone (6) directly adjacent thereto have the same outside diameter, the shaft connecting area and the connecting area between the valve shaft (1) and the valve cone (6) are designed as intermeshing connecting areas (4'), an exclusive shaft connecting area (4") on the one hand and the connecting area (4')on the other hand are situated a distance apart in the direction of the axis of the valve shaft (1).

3. The gas exchange valve according to claim 2, wherein the exclusive shaft connecting area (4") is situated completely inside an area in which the upper and lower shaft parts (2, 3) overlap axially.

* * * * *

UNITED STATES PATENT AND TRADEMARK OFFICE

CERTIFICATE OF CORRECTION

PATENT NO. : 7,603,976 B2
APPLICATION NO. : 11/444880
DATED : October 20, 2009
INVENTOR(S) : Marcus Abele It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 606 days.

Signed and Sealed this

Fifth Day of October, 2010

David J. Kappos

David J. Kappos
*Director of the United States Patent and Trademark Office*